US005097962A

United States Patent [19]

Eklof et al.

[11] Patent Number: 5,097,962

[45] Date of Patent: Mar. 24, 1992

[54] ADJUSTABLE GRAVITY FEED DISPLAY RACK APPARATUS AND METHOD

[75] Inventors: Thomas E. Eklof; Walter M. Poterbin; Roger L. Fernandez, all of Santa Cruz, Calif.

[73] Assignee: Santa Cruz Industries, Santa Cruz, Calif.

[21] Appl. No.: 635,476

[22] Filed: Dec. 28, 1990

[51] Int. Cl.[5] ..... A47F 5/00

[52] U.S. Cl. ..... 211/59.2; 211/184; 211/188

[58] Field of Search ..... 211/59.2, 59.3, 151, 211/194, 188, 184

[56] References Cited

U.S. PATENT DOCUMENTS

| | | | |
|---|---|---|---|
| 1,711,329 | 4/1929 | Short | 211/59.2 X |
| 2,443,871 | 6/1948 | Shield | 211/59.2 |
| 2,623,641 | 12/1952 | Shield | 211/59.2 |
| 2,730,825 | 1/1956 | Wilds | 211/59.2 X |
| 4,270,661 | 6/1981 | Rosenband | 211/59.2 |
| 4,331,243 | 5/1982 | Doll | 211/59.2 |
| 4,416,380 | 11/1983 | Flum | 211/194 X |
| 4,474,297 | 10/1984 | Zucker | 211/59.2 |
| 4,762,236 | 8/1988 | Jackle et al. | 211/59.3 |

*Primary Examiner*—Robert W. Gibson, Jr.
*Attorney, Agent, or Firm*—Flehr, Hohbach, Test, Albritton & Herbert

[57] ABSTRACT

An adjustable, gravity feed display rack comprising at least a first and a second vertical member forming a pair of vertical members and having front and rear support elements connected therebetween, the front support element defining a front of the display rack, the rear support element being located opposite the front support means and slightly higher therefrom. Also provided are a plurality of interchangeable trays located on the front and rear support means between the first and second vertical members such that items placed on the interchangeable trays move through the force of gravity to the front of the shelf. .

9 Claims, 3 Drawing Sheets

ADJUSTABLE GRAVITY FEED DISPLAY RACK APPARATUS AND METHOD

BACKGROUND OF THE INVENTION

1 Field of the Invention

The present invention relates to shelves or racks for the presentation of food items to consumers. More specifically, the present invention relates to an adjustable gravity feed display rack, preferably for various sized spice containers.

2. Summary of the Prior Art

Several types of display racks are known in the prior art. A particular feature of these display racks is that they are "self-fronting". Self-fronting refers to shelves which cause items on a shelf to be moved forward toward the front of the shelf. To the consumer, this presents an image of a full, well-stocked shelf of uniform arrangement. Studies have shown that consumers are more apt to purchase a product from a shelf that appears uniform and fully stocked because the items thereon are perceived as being fresher. To maintain a uniform shelf with all food items presented at the front of the shelf would require constant attention by store personnel. To alleviate such attention, self-fronting shelves have been devised which send the remaining items to the front of the shelf.

Two primary methods of producing self-fronting shelves are (1) using gravity or (2) a spring mechanism to move shelf items forward. A spring is primarily used when the items to be "fronted" are light weight and suffer substantial friction, such that the use of mere gravity would be inappropriate. Mechanical springs, however, induce several drawbacks. One drawback is that the springs introduce an additional part, which means one more part which can break and need replacing A second shortcoming is that springs are an additional cost not present in gravity feed systems.

Gravity feed self-fronting shelves have had wide application. They are often made of a metal structure, e.g., for milk bottles at dairies, or spices and other bottled products, and in one-piece, plastic extrusion for gum and miscellaneous items at convenience stores. A significant problem with the metal shelves or the one-piece plastic extrusions is that they are essentially rigid structures which provide no flexibility for varying sized products or varying quantities of products. Therefore, a need has arisen to create a gravity feed display rack which is adjustable to accommodate varying size products and varying quantities of product.

SUMMARY OF THE INVENTION

Accordingly, it is an object of the present invention to provide a gravity feed, adjustable display rack that is easily adjustable to variable container sizes.

It is another object of the present invention to provide a gravity feed, adjustable display rack having self-fronting shelves and which virtually eliminates visual "out of stock".

Moreover, it is another object of the present invention to provide a gravity feed, adjustable display rack which possesses quality aesthetics and is capable of free standing at an end-aisle or a grocer-shelf.

Furthermore, it is still another object of the present invention to provide a gravity feed, adjustable display rack which is capable of double stacking smaller size containers.

Another objective of this invention is to provide for vertically adjustable shelves so that products of different sizes cannot be easily accommodated without fixing the shelf spacing.

The attainment of these and related objects may be achieved through use of the novel adjustable, gravity feed spice rack herein disclosed. An adjustable, gravity feed spice rack in accordance with this invention has at least a first and a second vertical member forming a pair of vertical members and having front and rear support elements connected therebetween, the front support element defining a front of the display rack, the rear support element being located opposite the front support means and slightly higher therefrom. Also provided are a plurality of interchangeable trays located on the front and rear support means between the first and second vertical members such that items placed on the interchangeable trays move through the force of gravity to the front of the shelf.

The attainment of the foregoing and related objects, advantages and features of the invention should be more readily apparent to those skilled in the art, after review of the following more detailed description of the invention, taken together with the drawings, in which:

DETAILED DESCRIPTION OF A PREFERRED EMBODIMENT

Figure 1:
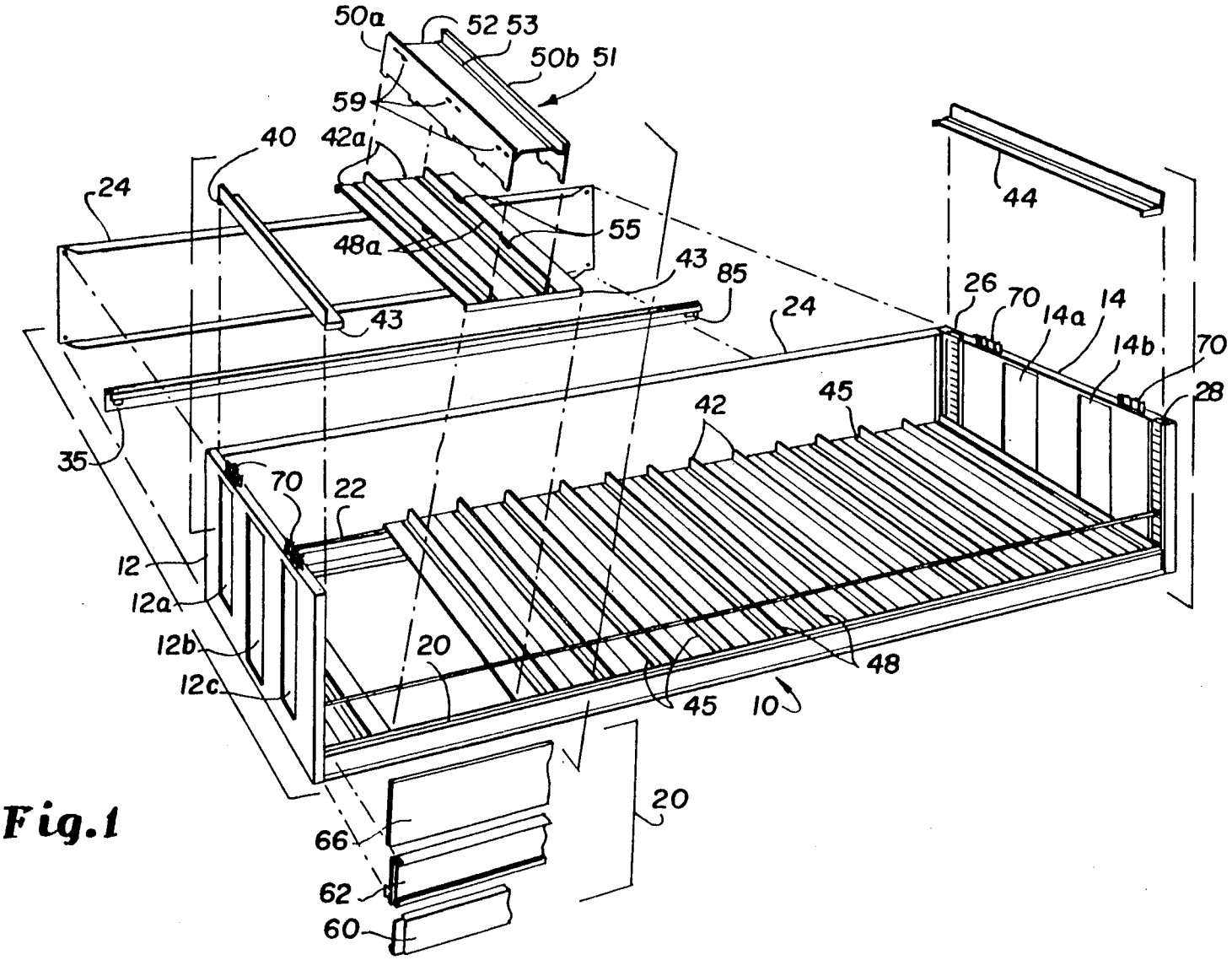
FIG. 1 is an exploded perspective view of the adjustable, gravity feed display rack of the preferred embodiment.

Referring to FIG. 1, an exploded perspective view of the display rack 10 of the preferred embodiment is shown. The display rack 10 primarily consists of vertical and horizontal members which support a plurality of various sized, interchangeable trays 42. The various sized trays 42 are to accommodate various sized containers. Additionally, for shorter containers, a two-tier rack system 51 may be used.

Figure 2:
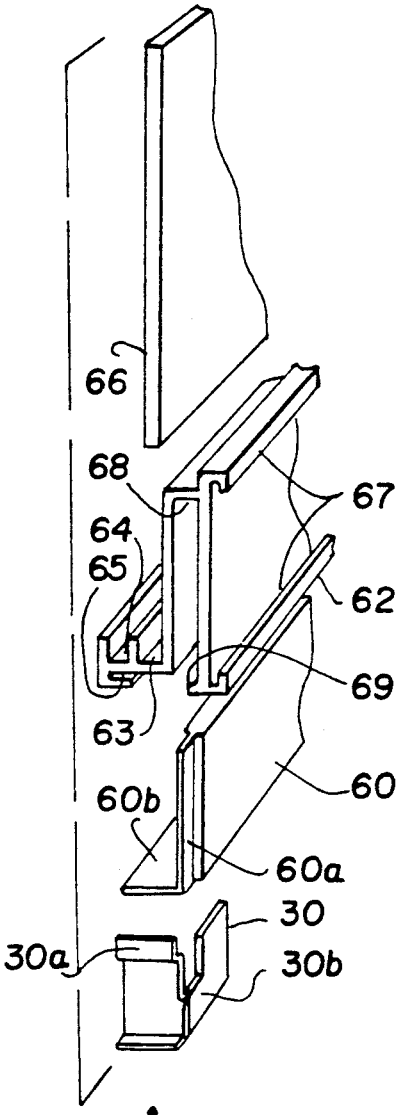
FIG. 2 is an isolated perspective view of the primary horizontal support of the preferred embodiment.

The primary vertical elements consist of a left wall 12 and a right wall 14. These two walls 12 and 14 are made of an injection molded plastic or wood. They may contain cavities 12*a*, 12*b*, and 12*c* for aesthetic purposes, to keep wall thickness uniform, and for strength. Cavities 14*a* and 14*b* similarly appear for aesthetic purposes, to keep wall thickness uniform, and for strength. The two walls 12 and 14 are joined by a plurality of front members 20, a plurality of rear members 22, and a rear section 24. The plurality of front members 20 and the rear members 22 are connected to the left and right walls 12 and 14 through a plurality of brackets (one of these brackets 30 is shown in FIG. 2). Located toward the front and the rear inside portions of each wall 12 and 14 is a metal strip 26 and 28 having rectangular openings therein. Each of the metal strips 26 and 28 on wall 14 (there are two identical metal strips on the inside of wall 12, but they are not visible from the perspective of FIG. 1) are connected solidly to the plastic injection mold or wood side through techniques which are well known in the art. Referring to FIG. 2, the top section 30*a* of a bracket 30 is placed in one of the rectangular openings in the metal strips 26 and 28 (and those not shown). In that position, a clip portion 30*b* extends from the bracket 30. The clip portion 30*b* is used to connect to the plurality of horizontal members 20 and the rear member 22.

Referring to FIG. 1, once the plurality of horizontal members 20 and the rear member 22 have been securely fastened to the walls 12 and 14, a plurality of trays 42 are placed between the two walls 12 and 14. Starting at the left wall 12, a left side, end portion 40 is situated directly adjacent the left wall 12. This end portion 40 represents one-half of a regular tray 42 and is off toward the wall 12. Similarly, an end portion 44 is provided next to wall 14. It provides the same function as end piece 40, but from an opposite direction. The trays 42 are disbursed in finite intervals according to package size between the end pieces 40 and 44. The spacing of the trays 42 is such that the entire area between the left and right walls 12 and 14 is covered. The walls 42 contain two particular features. The first feature is a lip 43. This lip 43 is also found on the end sections 40 and 44. The lip 43 is used to secure the trays 42 (and end portions 40 and 44) to the plurality of front members 20, as described below.

Each tray contains a divider 48. The divider 48 is basically a vertical member which runs the length of the tray 42 and prevents containers from wandering. Another feature of the trays 42 are the ribs 45. The ribs 45 are present because it has been shown that when an item is slid down a tray with a rib, there is less friction. The use of ribs 45 is well known in the art.

Another feature of the preferred embodiment is the use of a double rack structure for shorter containers. In FIG. 1, the double rack structure is illustrated by trays 42*a*, side members 50*a* and 50*b*, and cross-member 52. The side member 50 and cross-member 52 arrangement 51 is configured in width to have the same width as that between the dividers 48*a*. The side/cross-member arrangement 51 is mounted to the trays 42*a* through a plurality of teeth 56 extend from the side members 50 into openings 55 in the dividers 48*a*. The teeth 56 are arranged so that they protrude downward from the bottom of the side members 50, from alternate sides of each side member 50. The openings 55 are similarly alternated on opposite sides of each divider 48*a*. The arrangement of teeth 56 mirrors the arrangement of openings 55 so that the side/cross-member arrangement 51 fits securely onto the dividers 48*a*.

The foremost portion of the cross-member 52 is cut out circularly so that a customer can easily reach and extract a container situated on the trays 42*a*. Two ribs 53 are located on cross-member 52. These ribs serve the same function as ribs 45. One rib is substantially obscured, however, by side member 50*a*. Although only one side/cross-member arrangement 51 is illustrated, several of these arrangements 51 may be situated adjacent one another. In that instance, one common side member can support two cross members 52 so that in any arrangement you will always have one more side member than the number of cross-members. Such an arrangement is easily implemented using techniques well known in the art. In the preferred embodiment, a plurality of opening pairs 59 are located in each side member 50 and tabs from cross-members 52 protrude into the opening pairs 59. Each cross-member 52 has a plurality of tabs (not shown) extending from its left and right sides. The tabs on the left side insert into the rear of each opening pair 59 and tabs on the right side insert into the forward hole of each opening pair 59.

Referring to FIG. 2, an isolated extended view of the plurality of front members 20 and bracket 30 is shown. A formed sheetmetal member 60 is mounted inside a plastic extrusion 62. The plastic extrusion has two cavities 63 and 64. In the first cavity 63, a clear piece of plastic 66 is inserted. This clear piece of plastic 66 runs the entire horizontal length of the display rack and essentially acts as a retaining wall, maintaining containers on display within the rack 10. The second cavity 64 also runs the horizontal length of the display rack 10 and serves as an anchor for the lip 43 of each tray 42, each lip 43 fitting into cavity 64. The end 60*a* of the formed sheetmetal 60 (at the left and right sides) is pressed together. Just after the pressed together section 60*a*, the formed sheetmetal 60 is hollow. The clip section 30*b* of bracket 30 fits into this hollow region and holds the formed sheetmetal 60 securely. The formed sheetmetal 60 fits inside the large cavity 68 in the plastic extrusion 62. The bottom flat portion 60*b* of the formed sheetmetal 60 fits into cavity 65 while the main portion of the formed sheetmetal is also maintained by lip 60. Note also that the front of the extruded plastic section 62 contains two molded lips 67 for securing labels. The formed sheetmetal 60, plastic extrusion 62 and retaining wall 66 are the same as those elements 60, 62 and 66 of FIG. 1.

Figure 3:
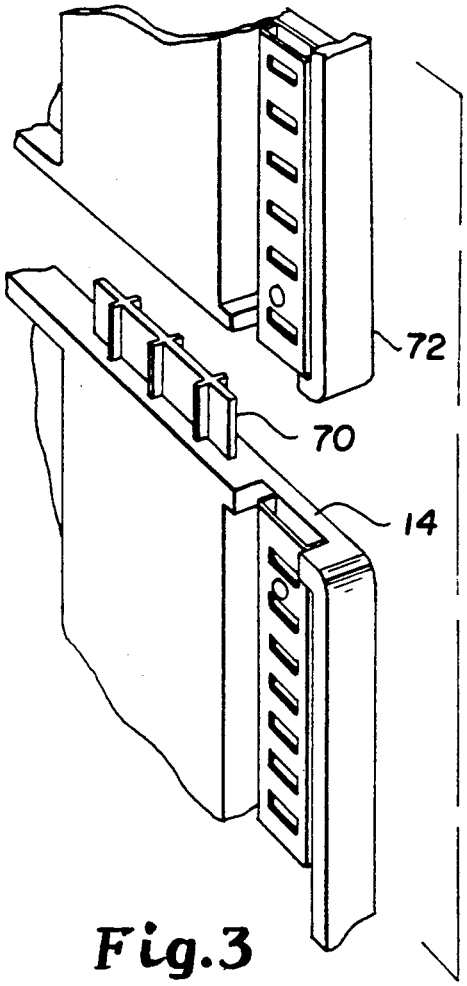
FIG. 3 is an isolated perspective view illustrating the connection of two vertical members to one another in accordance the preferred embodiment.

Referring to FIG. 3, the manner in which two vertical sections are connected is illustrated. Extending from, in this instance, the right side 14 is a specifically configured nub 70, a similarly shaped cavity (not shown) exists in the next higher vertical section of the right wall 72. The nub 70 fits securely into the cavity, thereby securing a vertical section to the next vertical section above it. The nubs 70 are indicated in FIG. 1 on both the left wall 12 and the right wall 14. Using this arrangement, the walls may be built as high as necessary within safety limits. Of course, use of this particular arrangement is not required to assemble the side walls. For example, defining holes in the top and bottom of each wall section (in place of the nubs and cavities) allows use of a steel pin to align and connect the sections.

Figure 4:
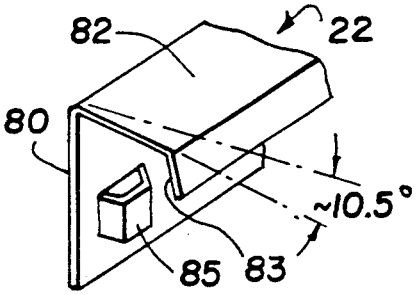
FIG. 4 is a perspective view of one end of the rear member of the preferred embodiment.

Referring to FIG. 4, a perspective view of one end of the rear member 22 is shown. The rear member has a back portion 80, a top portion 82 and a front portion 83. In the preferred embodiment, the top portion 82 is sloped forward and downward at an angle from the horizontal from which is selected according to the product to be displayed. An angle of about 10.5° from the horizontal has been determined to be an ideal slope for trays 42. Therefore, it is preferable in attaching the plurality of rear members 22 and the plurality of front members 20 to the metal strips (26 and 28) that an angle of 10.5 degrees from rear to front result. The bracket 30 (of FIG. 2) is also used on conjunction with the rear member 22. The clip portion 30*b* fits into the slot within extended member 85. Extended member 85 for both ends of the rear member 22 are shown in FIG. 1.

Figure 5:
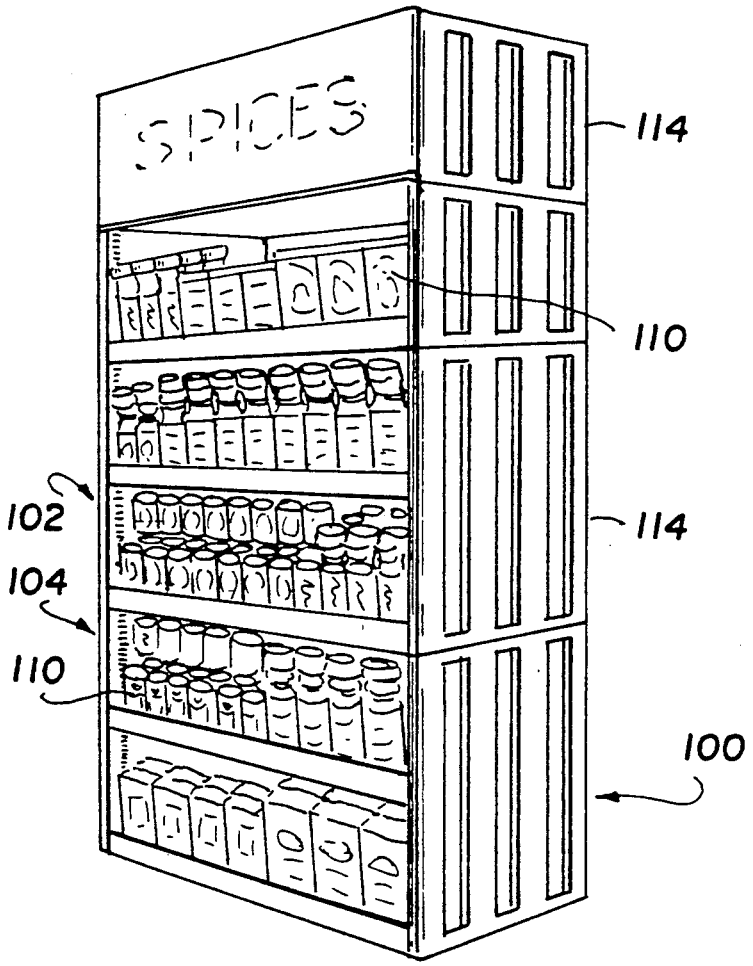
FIG. 5 is a perspective view of a display rack incorporating the present invention.

Referring to FIG. 5, a perspective view of one configuration of the adjustable, gravity feed display rack 100 is shown. The display rack 100 contains several assorted size containers 110. Double shelf arrangements (51 of FIG. 1) are indicated by reference numerals 102 and 104. Note also that the vertical wall sections 114 may come in different sizes.

Figure 6:
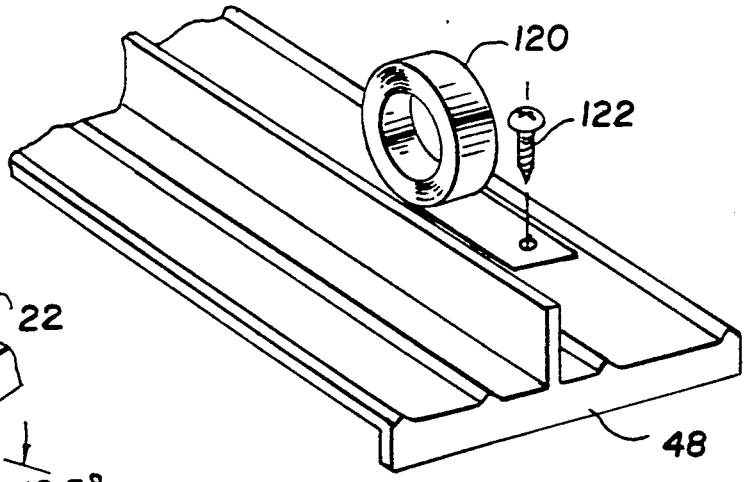
FIG. 6 is a perspective view of a spring assist for cans and cartons.

FIG. 6 illustrates a spring assist device for cans and cartons. To ensure that cans and cartons will gravity-feed to the front of the shelf 48, it may be desirable to add a coil spring 120 fastened to the middle of the shelf region where the cans and cartons slide. A screw or equivalent device 122 is used to fasten one end of the spring to the shelf 48. As cans and cartons are inserted, the spring unrolls behind them so that the coil is always behind the rearmost can or carton. The spring force as the spring recoils applies pressure to the rearmost can or carton so that the row of cans or cartons is always pushed to the front. Without the use of this device, heavier cans or cartons may sit on the shelf and not appear at the front face of the shelf as desired.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. An infinitely adjustable, gravity feed display rack, comprising:

at least a first and a second vertical member forming a pair of vertical members;

front and rear support means connected between said first and second vertical members, said front support means defining a front of said display rack, said rear support means being located opposite said front support means and slightly higher therefrom;

a plurality of interchangeable trays located on said front and rear support means between said first and second vertical members, each of said trays comprising a horizontal segment and a vertical divider element supported on the horizontal segment, adjacent ones of said trays supporting adjacent divider elements and being horizontally moveable to accommodate products of different sizes between said dividers;

secondary shelf means occupying a position above at least one of said trays; and means for attaching said secondary shelf means to one of said plurality of interchangeable trays so that relatively smaller products may be supported on said secondary shelf means.

2. The display rack of claim 1 wherein a trough is formed in said front support member; and each of said interchangeable trays further includes means comprising a lip extending down from the front of the tray and slidable in said trough.

3. The display rack of claim 2 in which plurality of trays are positioned in vertically spaced-apart relationship; and said secondary shelf means occupies an intermediate position vertically spaced between an adjacent pairs of said trays; and said secondary shelf means is connected to said dividers on at least one of said interchangeable trays so that relatively small products may be supported on said secondary shelf means.

4. The display rack of claim 1 which further comprises:

at least a third and fourth vertical member forming a second pair of vertical members;

said second pair of vertical members mounting on top of said first pair of vertical members to extend the display rack in the vertical direction;

said first pair of vertical members having a plurality of nubs extending from a top thereof; and said second pair of vertical members having a plurality of cavities located at a bottom thereof, said plurality of cavities being configured in an arrangement to receive said plurality of nubs on said first pair of vertical members so that said first and second pair of vertical members are held together securely.

5. The display rack of claim 1 which includes spring assist means for exerting a yieldable force against the products in a direction toward said front of the display rack for automatically moving product at the rear of the tray forwardly as product at the front is withdrawn.

6. The display rack of claim 5 in which the spring assist means includes a flexible band of spring material having a proximal end portion and a distal end portion, said proximal end portion being fastened to the tray and said distal end portion being wound into a coil which is positioned in juxtaposed relationship with rearmost product on the tray whereby the spring force tends to unwind the coil and move the coil thereby the product toward the front of the rack.

7. The display rack of claim 1 in which the front support means comprises a plurality of elongated extrusion members, each extrusion member extending transversely between the first and second vertical members and in front of the trays, means providing an upwardly open cavity extending along the extrusion member, and an elongated, substantially transparent retaining wall mounted in said cavity of the extrusion member, said retaining wall having a vertical height sufficient to retain the product on the trays while enabling the product labels and graphics to be seen through the retaining wall from the front of the display rack.

8. An infinitely adjustable, gravity feed display rack comprising:

at least a first and second vertical member forming a pair of vertical members;

front and rear support means connected between said first and second vertical members, said front support means defining a front of said display rack, said rear support means being located opposite said front support means and slightly higher therefrom;

a plurality of interchangeable trays located on said front and rear support means between said first and second vertical members, each of said trays comprising a horizontal segment and a vertical divider element supported on the horizontal segment, adjacent ones of said trays supporting adjacent divider elements and being horizontally moveable to accommodate products of different sizes between said dividers;

said front support means comprising a plurality of elongated extrusion members, each extrusion member extending transversely between the first and second vertical members and in front of the trays, means providing an upwardly open cavity extending along the extrusion member, and an elongated substantially transparent retaining wall mounted in the cavity of each extrusion member, said retaining wall having a vertical height sufficient to retain product on the tray while enabling the product labels and graphics to be seen through the retaining wall from the front of the display rack.

9. The display rack of claim 1, wherein said rear support means is higher than said front support means by a defined angle of approximately 10.5 degrees from the horizontal, so that items on said interchangeable trays move through the force of gravity toward the front of said display rack.

* * * * *